United States Patent [19]

von Hagen

[11] Patent Number: 4,748,839

[45] Date of Patent: Jun. 7, 1988

[54] DIFFERENTIAL FEED ADJUSTING MECHANISM

[75] Inventor: Wolf-Rudiger von Hagen, Hemmingen, Fed. Rep. of Germany

[73] Assignee: Union Special G.m.b.H., Stuttgart, Fed. Rep. of Germany

[21] Appl. No.: 26,513

[22] Filed: Mar. 17, 1987

[30] Foreign Application Priority Data

Mar. 26, 1986 [DE] Fed. Rep. of Germany ..... 3610125

[51] Int. Cl.[4] ..... D05B 27/08

[52] U.S. Cl. ..... 112/313

[58] Field of Search ..... 112/312, 313, 462

[56] References Cited

U.S. PATENT DOCUMENTS

| | | | |
|---|---|---|---|
| 3,967,565 | 7/1976 | Hirayama et al. | 112/313 |
| 4,027,609 | 6/1977 | Kerr | 112/313 |
| 4,436,045 | 3/1984 | Bonham et al. | 112/313 |
| 4,527,497 | 7/1985 | Kerr et al. | 112/313 |
| 4,624,202 | 11/1986 | Alberti et al. | 112/313 |

*Primary Examiner*—H. Hampton Hunter

*Attorney, Agent, or Firm*—Powell L. Sprunger

[57] ABSTRACT

A sewing machine having differential material feed, with a main feed dog and differential feed dog being mechanically connected to one another in such a manner that if the feed stroke length of the first feed dog is changed, the feed stroke length of the second feed dog is changed inversely in a predetermined ratio.

11 Claims, 3 Drawing Sheets

DIFFERENTIAL FEED ADJUSTING MECHANISM

BACKGROUND OF THE INVENTION

The present invention relates to sewing machines with differential feed.

Sewing machines having differential feed are generally known for example from German Patent Specification 10 71 461 corresponding to U.S. Pat. No. 2,965,056. In sewing machines having differently adjusted feed stroke lengths of main and differential material feed dogs, there is a particular ratio between these two feed stroke lengths. If this ratio alters as a result of an increase in the feed stroke length of the differential feed dog, in the case of known sewing machines with differential feed, the length of the stitch in the material to be sewn will also increase. Such a result is disadvantageous. In order to maintain the same stitch length, it is necessary, given a change in the differential ratio, to make a time-consuming readjustment of the main feed.

SUMMARY OF THE PRESENT INVENTION

A principal feature of the present invention is the provision of an improved sewing machine with differential feed.

The sewing machine of the present invention comprises, a main feed dog, and a differential feed dog.

A feature of the present invention is the provision of means for adjusting the feed stroke length of the differential feed dog while maintaining a constant stitch length of the sewing machine.

Thus, another feature of the invention is that the sewing machine is adjusted in such a way that the stitch length remains constant when the differential ratio is changed.

A further feature of the invention is that when the differential feed dog is adjusted, the feed stroke length of the main feed dog is automatically adjusted inversely in a predetermined ratio.

Thus, a feature of the present invention is that it is no longer necessary to perform a time-consuming readjustment of the main feed when the differential feed is adjusted.

Further features will become more fully apparent in the following description of the embodiments of this invention and from the appended claims.

DESCRIPTION OF THE PREFERRED EMBODIMENTS

Figure 1:
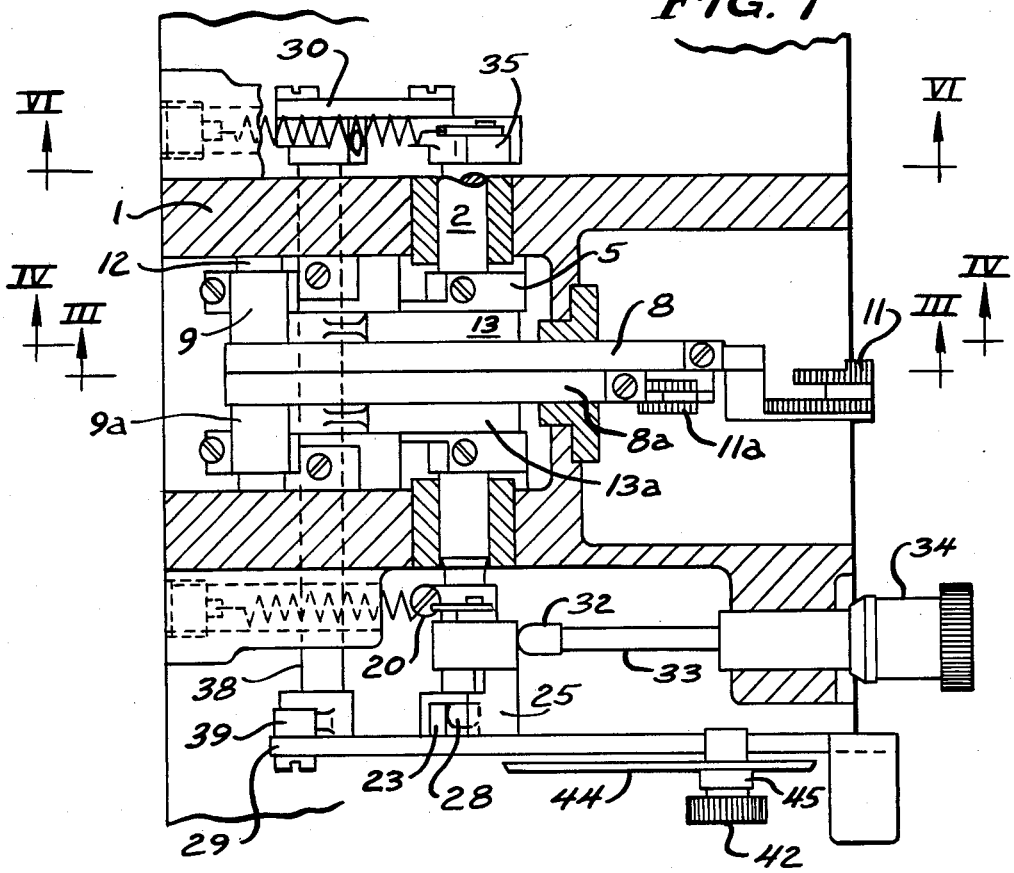
FIG. 1 is a plan view of a differential feed device of the present invention for a sewing machine.
Figure 2:
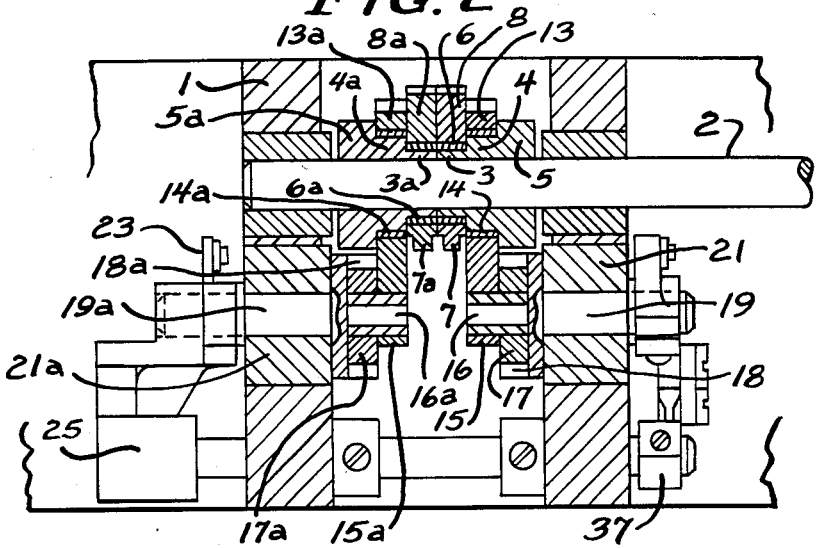
FIG. 2 is a sectional view taken substantially as indicated along the line II—II of FIG. 3.
Figure 3:
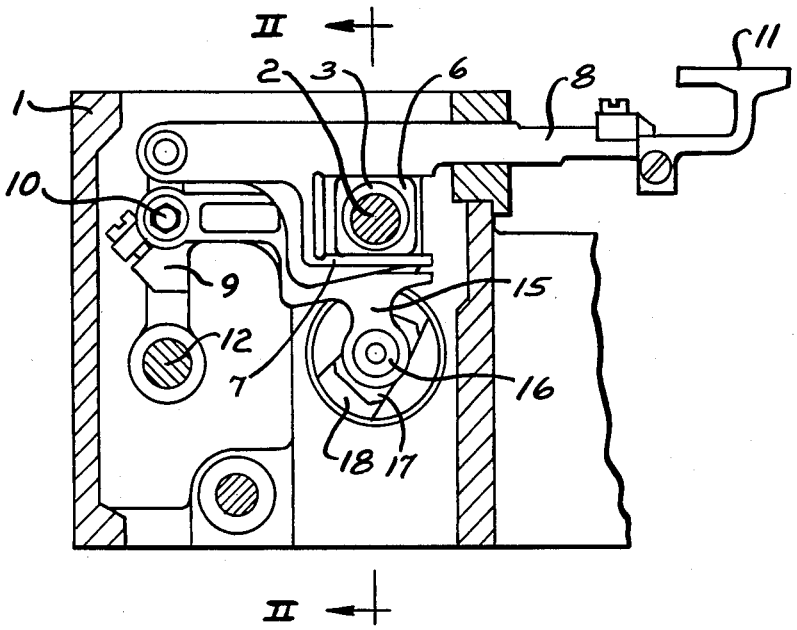
FIG. 3 is a sectional view taken substantially as indicated along the line III—III of FIG. 1.

The differential feed device is disposed in a sewing machine housing 1, and is driven by a shaft 2. Two eccentric arrangements are disposed on the shaft 2 and each comprises a lifting eccentric disc 3, a stroke eccentric disc 4 and a counterbalance disc 5. The lifting eccentric disc 3 is enclosed by a sliding block 6 which is mounted in a fork 7 of a feed dog carrier 8. One end of the feed dog carrier 8 is pivoted on a respective frame 9 and the other end carries a feed dog 11. The frame 9 is mounted on an axle 12 which is fixed to the housing 1, and is articulated by way of a pivot point 10 with a fork 13. A sliding block 14 lies in the fork 13 and embraces the stroke eccentric disc 4. On the fork 13 there is an arm 15 which carries a bolt 16 on which a sliding block 17 is mounted. The sliding block 17 is guided in an arcuate guideway 18 which is provided on a respective adjusting shaft 19. The adjusting shaft 19 is mounted in the sewing machine housing 1 by means of a bushing 21.

Parts **3*a* to 21*a* are the same as parts 3 to 21, apart from 8*a* and 11*a*, and some are disposed as mirror images of one another. Parts 3 to 21 for driving the feed dog 11 form the differential feed device, and parts 3*a* to 21*a* for driving the feed dog 11*a*** form the main feed device.

Figure 5:
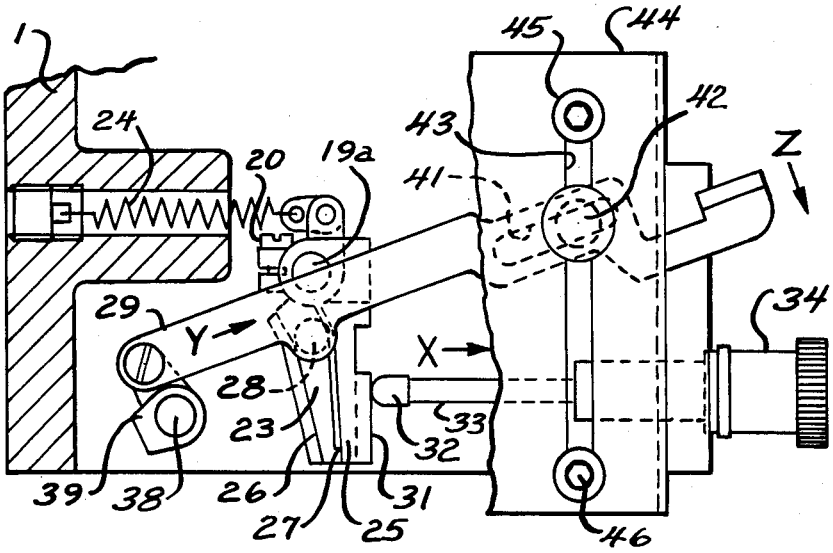
FIG. 5 is a front view of the device of FIG. 1.

As shown in FIG. 5, a double lever 23 is clamped to the adjusting shaft **19*a* by a screw 20, and a tension spring 24 acts between the lever 23 and the sewing machine housing 1. A lever 25 is pivotally mounted on the adjusting shaft 19*a*. The levers 23, 25 have cam tracks 26 and 27, which are coupled together by way of a bolt 28. The bolt 28 is located on a pivotable adjusting lever 29. On the opposite side of the cam track 27 to the bolt 28 there is a stop face 31 which abuts against a stop 32. The stop 32 is formed by the free end of a bolt 33 which moves in an adjusting screw 34**.

Figure 6:
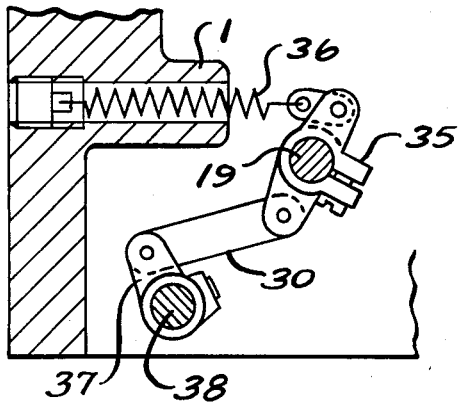
FIG. 6 is a sectional view taken substantially as indicated along the line VI—VI of FIG. 1.

As shown in FIG. 6, a double lever 35 is clamped to the adjusting shaft 19 and a spring 36 acts between the lever 35 and the sewing machine housing 1. The double lever 35 is connected by way of a connecting rod 30 to a lever 37 on an auxiliary shaft 38. The end of the auxiliary shaft 38 projecting out of the sewing machine housing 1 carries a lever 39 (FIG. 5) to which the adjusting lever 29 is pivotally connected. The adjusting lever 29 is provided with a longitudinal slot 41 into which projects a locking screw 42 which is also guided in a slot 43 in a housing cover 44. The slot 43 contains adjustable stops 45, 46 to limit the pivoting angle of the adjusting lever 29.

Figure 4:
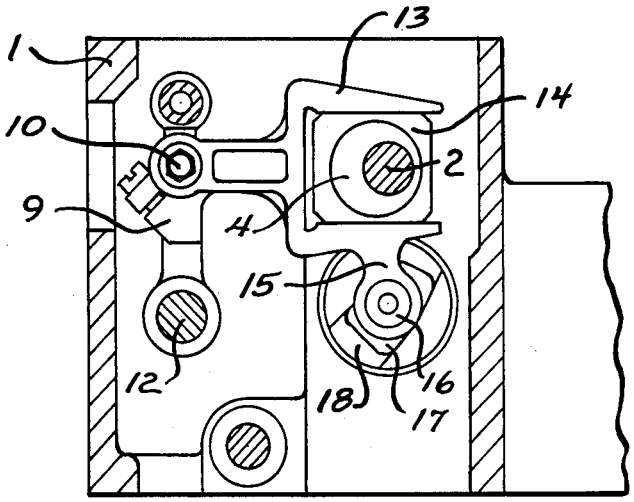
FIG. 4 is a sectional view taken substantially as indicated along the line IV—IV of FIG. 1.

Starting from the initial position shown in FIG. 5, the stop 32 is drawn back in the direction of the arrow X by turning the adjusting screw 34. As a result, the lever 25 turns in an anti-clockwise manner about the central axis of the adjusting shaft **19*a*, as the double lever 23 presses, as a result of the force of the spring 24, by way of the bolt 28 onto the lever 25. The double lever 23 also turns the adjusting shaft 19*a* in an anti-clockwise manner. As a result, the arcuate guideway 18*a* is moved out of its concentric position about the pivot point 10*a* (not shown) of the fork 13*a* and the arm 15*a* thereon (cf. FIG. 4). With the guideway 18*a* in this position, the up and down motion of the sliding block 17*a* conveys a reciprocating motion to the fork 13*a* which sets the frame 9*a* into a rocking motion. The rocking motion of the frame 9*a* causes a longitudinal motion of the feed dog carrier 8*a*, on whose free end the main feed dog 11*a*** is secured.

By adjusting the adjusting screw 34 as described, the adjusting lever 29 is moved by way of the bolt 28 in the direction of the arrow Y and hence the auxiliary shaft 38 is turned in the clockwise direction. The auxiliary shaft 38 turns the adjusting shaft 19 by way of the connecting rod 30 in the clockwise direction, as a result of which the same adjustment of the guideway 18 takes place as in the above-described adjustment for the main feed dog 11*a*. Hence, both feed devices have the same feed stroke length.

In order to increase the feed stroke length of the differential feed dog 11 over that of the main feed dog 11*a*, the adjusting lever 29 is moved in the direction of the arrow Z. As a result, the bolt 28 is moved between the levers 23 and 25 in the direction of their free ends. As the bolt 28 is pressed against the lever 25 by way of the double lever 23 as a result of the force of the spring 24, said bolt 28 moves along the cam track 27 of the lever 25, as a result of which the adjusting lever 29 is moved further in the direction of the arrow Y. This displacement of the adjusting lever 29 causes the auxiliary shaft 38 to be further rotated in the clockwise direction and hence the adjusting shaft 19 to be further rotated in the anti-clockwise direction, as a result of which the eccentricity of the arcuate guideway 18 with respect to the pivot point 10 is further increased and the differential feed device is given a longer travel. At the same time, displacement of the bolt 28 in the direction of the free ends of the levers 23 and 25 causes the double lever 23 and the adjusting shaft 19*a* to rotate in the clockwise direction, because the gap between the cam tracks 26 and 27 becomes similar in the direction of the free ends of the levers 23 and 25. As a result, the previously set feed stroke length of the main feed dog 11*a* is reduced by a predetermined amount and the stitch length is kept constant for different feed lengths of the differential feed dog 11.

The foregoing detailed description is given for clearness of understanding only, and no unnecessary limitations should be understood therefrom, as modifications will be obvious to those skilled in the art.

I claim:

1. A sewing machine having differential material feed and main and differential feed dogs which are adjustable relative to one another with respect to the ratio of the feed stroke lengths, respective adjusting means and setting elements to set the feed stroke lengths associated with each material feed dog, and an intermediate setting element is disposed between the adjusting means, and thereby coupling the adjusting means to one another to form a drive which, when the first setting element is displaced, in order to displace the first adjusting means so as to change the feed stroke length of the first material feed dog, actuates the second adjusting means such that the feed stroke length of the second material feed dog is altered inversely in a predetermined ratio.

2. The sewing machine of claim 1 wherein the intermediate setting element in order to couple the adjusting means comprises two parts which can be displaced relative to one another and which are coupled together by a coupling piece, which is in turn connected to the first setting element.

3. The sewing machine of claim 2 wherein the two relatively displaceable parts are levers which are resiliently biased towards one another and towards a stop, with one lever being secured to one of the two adjusting means, and in which the coupling piece comprises a bolt which is displaceably disposed between the two levers.

4. The sewing machine of claim 3 wherein the stop against which the relatively displaceable parts are biased is a part of a second setting element.

5. The sewing machine of claim 4 wherein the second setting element is an adjusting screw which is mounted in the housing and whose end projecting into the housing forms the stop.

6. The sewing machine of claim 1 wherein the adjusting means comprise adjusting shafts each of which has a guideway in which sliding blocks, driven by feed stroke generating eccentric discs, and mounted to convey longitudinal motion to the material feed dogs.

7. The sewing machine of claim 3 where the adjusting means comprise adjusting shafts each of which has a guideway in which sliding blocks, driven by feed stroke generating eccentric discs, are mounted to convey longitudunal motion to the material feed dogs.

8. The sewing machine of claim 7 wherein the two levers are disposed on the same adjusting shaft, with one lever being rigidly connected to such adjusting shaft and the other lever being pivotaly mounted thereon.

9. The sewing machine of claim 1 wherein the first adjusting means is connected by way an intermediate shaft to the first setting element.

10. The sewing machine of claim 9 wherein the first setting element comprises a setting lever, one end of which projects out of the sewing machine housing and the other end of which is connected to a lever on the intermediate shaft.

11. The sewing machine of claim 10 wherein the pivotal motion of the setting lever is limited by stops and the setting lever carries an adjusting screw by means of which the pivot motion of the setting lever can be fixed.

* * * * *